US005889222A

United States Patent [19]

Burgess

[11] Patent Number: 5,889,222

[45] Date of Patent: Mar. 30, 1999

[54] DEVICE FOR ALTERING THE EFFECTIVE MASS OF A STRINGED INSTRUMENT

[76] Inventor: David Burgess, 1510 Glen Leven, Ann Arbor, Mich. 48103

[21] Appl. No.: 775,064

[22] Filed: Dec. 27, 1996

Related U.S. Application Data

[63] Continuation of Ser. No. 426,950, Apr. 21, 1995, abandoned.

[51] Int. Cl.[6] ..... G10G 3/00

[52] U.S. Cl. ..... 84/453; 84/327; 84/279

[58] Field of Search ..... 84/453, 454, 279, 84/280, 327

[56] References Cited

U.S. PATENT DOCUMENTS

| | | | |
|---|---|---|---|
| 3,636,809 | 1/1972 | Ezaki | 84/453 |
| 4,493,238 | 1/1985 | Ricci | 84/453 |

*Primary Examiner*—Cassandra C. Spyrou
*Attorney, Agent, or Firm*—James M. Deimen

[57] ABSTRACT

A device for altering the effective mass of a stringed instrument employs a movable mass such as an adjustable calibrated weight affixed to an accessory or member on the body of the instrument. The adjustable weight is a known weight and in the form of a movable mass clamp that can be externally mounted on the endpin of a cello or bass. The adjustable weight can be a "C" shaped body or a split collar style body with either one employing a threaded fastener to hold the body on the endpin. A variation encompasses a mounted adjustable weight in the form of a clamp affixed to some portion of an instrument. The clamp has a flexible interface or pad between the clamp and the instrument. A series of varying weights can be selected to be applied to the clamp. Another variation employs the endbutton on a violin. The endbutton has an opening disposed therethrough with threads provided therein. From a series of pins having threads disposed thereon, a pin is selected and is threadably engaged with the endbutton to place a selected mass inside the body of the violin. A friction fit may be used in lieu of threads. The pins can be tapered with the head of each pin having either a recessed socket or a raised cross bar to facilitate turning the pin into engagement with the endbutton. Consequently, due to the placement of a selectable mass in a selected position on a member on the body of a stringed instrument, the tone and feel can be more effectively and repeatably controlled.

19 Claims, 2 Drawing Sheets

DEVICE FOR ALTERING THE EFFECTIVE MASS OF A STRINGED INSTRUMENT

This is a continuation of co-pending application Ser. No. 08/426,950 filed on Apr. 21, 1995.

BACKGROUND OF THE INVENTION

The field of the invention pertains to stringed instruments. In particular, the invention pertains to a device for altering the effective mass of a stringed instrument. Objectionable tones can resonate from an instrument under certain playing conditions. Perhaps best known is the "wolf" that can emanate from a violincello. Changing of the mass in certain parts of the instrument can somewhat assuage the objectionable tones.

During construction of a stringed instrument by a master craftsman, the mass of the various parts can be controlled by varying the thickness of the parts of the instrument body. The effective mass is presumed to be nonadjustable after the instrument is completed. Unfortunately, environmental factors including heat and humidity can result in different harmonic overtones in the instrument from day to day.

Attempts have been made to control the objectionable tones. "Wolf eliminators" are resonance dampers and are intended to control a very large resonance peak. Such devices sometimes interfere with playing at a certain frequency. It is often desirable to occlude or prevent only certain limited objectionable tones. In the past, a lump of clay has been adhered to various areas of the body of a stringed instrument in an attempt to alter the sound. However, the desirous effect of a lump of clay is difficult to adjust for varying conditions and it is very difficult to replicate the proper amount successfully because the size, weight and positioning of the lump may vary greatly. Usually clay lumps are used experimentally, not by most players as the clay lumps may not remain attached.

U.S. Pat. No. 2,974,556 discloses an end-rest assembly for violincellos and base viols to protect the floor from the pointed endpin.

U.S. Pat. No. 4,493,238 discusses placing a movable weight on a violin bow to adjust the "bounce" of the bow as it moves across the strings.

U.S. Pat. No. 2,444,280 shows a device for suppressing objectionable "wolf" tones in an instrument of the violin family. The device attaches to the tailpiece and contacts the body adjacent the tailpiece.

U.S. Pat. No. 5,003,858 discusses a portable resonating platform and t-bar for securing the endpin and enhancing the tone of a cello.

U.S. Pat. No. 1,777,070 discloses a violin having means for varying the volumetric capacity of the body and thereby modifying vibration of the air within the body. Selection of pins for different volume changes is disclosed, however, modification by change of mass is not disclosed.

Thus, no known device exists to facilitate the easy alteration and the repeatability of the alteration of the mass of a stringed instrument when the device is affixed to the body of the instrument or to an accessory on the instrument.

SUMMARY OF THE INVENTION

The invention comprises a device for adjustably altering the effective mass of a stringed instrument, but is not limited thereto. Essentially, the invention comprises a movable mass that is selectable as to a predetermined weight, and that is adjustably positioned on a member of the body of the instrument to change the character of the sound and the way the instrument feels to the player. The effective mass may also include a flexible or elastic portion interposed between the mass and the instrument body.

One variation comprises an external clamp that is adjustably positioned on the endpin of a cello or other stringed instrument having an endpin. By positioning the clamp in a different location on the endpin, a different effective mass is achieved because of the compliance of the endpin. Further, effective mass can be controlled by inserting an elastic material between the clamp and the endpin and then adjusting the clamping pressure of the clamp to the endpin.

Another device according to the invention utilizes the endbutton of a violin. The endbutton is provided with an aperture therethrough. Tapered pins of varying mass can be suitably inserted into and affixed to the violin through the aperture in the endbutton.

A further variation of the invention is an alteration to the chinrest of a violin comprising a flexible interface adjustably positioned between the chinrest and a selectively weightable clamp.

It is envisioned that the device be adjustably attached to an accessory of or a member connected to a stringed instrument. For the violin or other hand-held instruments, the device is attached to the endbutton, to the chinrest, or attached by means of a clamp as a separate accessory to the instrument body. However, for a cello, bass viol or other large instrument, the device is attachable to the endpin of the instrument. By moving the adjustable device, the effective mass of the instrument is altered, thereby affecting the sound emanating from the instrument. Further adjustment can be obtained by inserting a flexible or elastic material between the clamping device and the instrument body or accessory.

The necessary action required to achieve the alteration in the effective mass of a stringed instrument is facilitated by the use of known weights in readily ascertainable locations. Moreover, as no unmeasured lump of material is used, the replication of the effect can be more easily attained.

The invention can be advantageously employed on a totally new stringed instrument. The invention is also useful as a retrofit to an existing stringed instrument. While directed to the stringed instruments discussed above, the invention herein disclosed is not limited thereto but has other uses such as for alteration of the mass of other stringed instruments such as guitars, zithers, autoharps, harps and pianos.

For a more complete understanding of the present invention, reference is made to the following detailed description when read in conjunction with the accompanying drawings wherein like reference characters refer to like elements throughout the several views.

BRIEF DESCRIPTION OF THE DRAWINGS

s

DESCRIPTION PREFERRED EMBODIMENT

Figure 1:
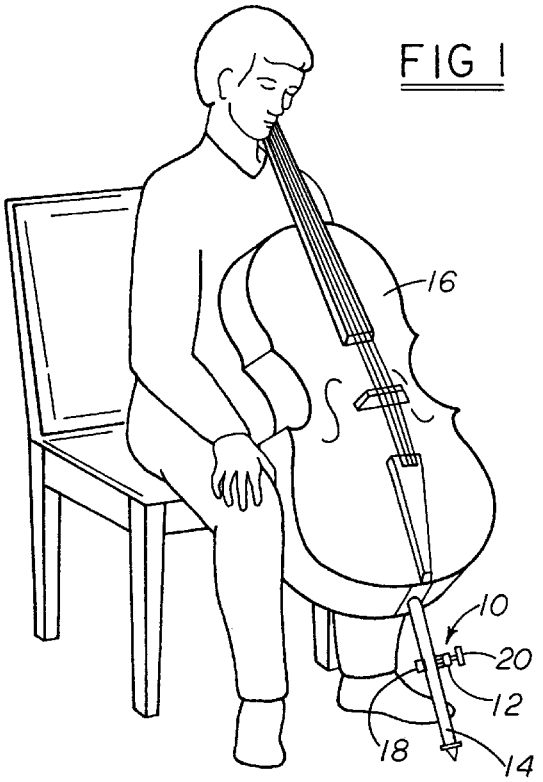
FIG. 1 illustrates an environmental view of the movable mass device according to the invention showing the device on a cello.

In FIG. 1, a device generally denoted as 10 is shown. The device 10 comprises a movable mass hereshown as an adjustable "C" clamp 12 affixed to the endpin 14 of a cello 16. The adjustable clamp 12 comprises a clamp body 18 and a clamping screw 20.

Figure 2A:
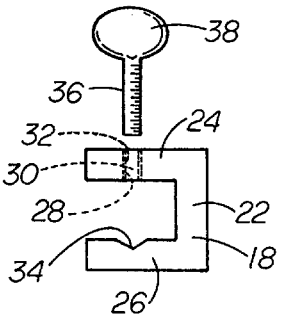
FIG. 2A illustrates a top view of the movable mass clamp of FIG. 1.
Figure 2B:
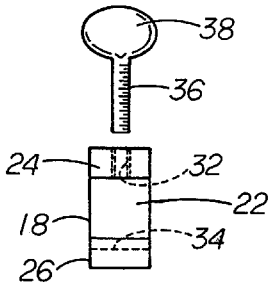
FIG. 2B illustrates a left side view of the movable mass clamp of FIG. 2A.

Now turning to FIGS. 2A and 2B the clamp body 18 is shown more clearly. The clamp body 18 takes the shape of a "C" clamp. The clamp body 18 has a back 22 and two arms 24, 26 extending from opposite sides of the back 22. An aperture 28 pierces one of the arms 24 and includes threaded engagement means 30 disposed therein. The engagement means 30 can alternatively be other means such as detents. The arm 26 which is opposite the arm 24 having the aperture 28 therein has a notch 34 facing the aperture 28 and generally aligned with the aperture 28. The notch 34 has the shape of a "V" groove and assists the clamp to fit around and hold to the endpin 14.

Threaded means for clamping 36 the body 18 onto the endpin 14 engages the threaded means 30. A thumbscrew 38 comprises the means for clamping 36 but other means for clamping such as a screw with a knurled head could be advantageously employed. By using threaded means for clamping 36 to engage the threads 32 the tightness of the "C" clamp body 18 to the endpin 14 can be controlled as a fine adjustment further explained below.

The endpin 14 actually functions as a spring. The compliance of the endpin 14 therefore changes with changes in the extension of the endpin from the instrument. This extension length of the endpin 14 is determined by the size and posture of the player. The weight delivered by the "C" clamp or a heavier or lighter clamp provides an adjustment on the endpin 14 to vary the effective mass by selectably varying the compliance of the weight and endpin combination. Thus, the tone and feel can be better controlled and the specific placement and weighting parameters of the movable mass clamp can be replicated when necessary. Further, the tightness of the "C" clamp to the endpin 14 can act as a means to fine tune the compliance of the endpin 14 and therefore the effective mass.

Figure 2C:
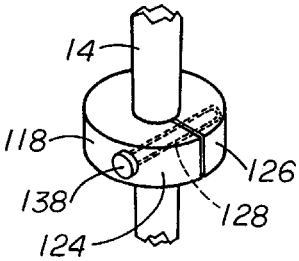
FIG. 2C illustrates a split collar style of the movable mass clamp.

Alternatively, a round shaped body 118 as seen in FIG. 2C can be used as the movable mass clamp. The round shaped body 118 is a split collar style of clamp body 18. A threaded aperture 128 through the two nearby ears 124, 126 engages a set screw 138 threaded to draw the ears 124, 126 together around the endpin 14.

Figure 3:
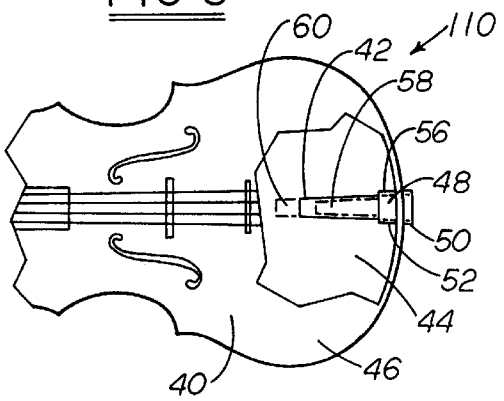
FIG. 3 illustrates a cutaway view of the lower portion of a violin showing a tapered mass pin installed in the violin with other mass pins shown in phantom.
Figure 4A:
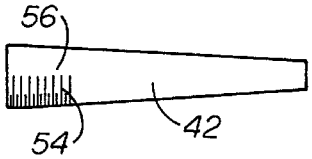
FIG. 4A illustrates a side view of a tapered pin.
Figure 4B:
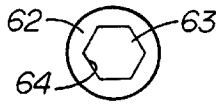
FIG. 4B illustrates a head end view of a tapered pin showing a recessed socket.
Figure 4C:
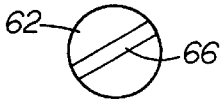
FIG. 4C illustrates a head end view of a tapered pin having a raised crossbar.

A variation 110 of the device is depicted in FIGS. 3–4C for use with a violin or other small handheld instrument. The cutaway view of FIG. 3 shows a violin 40 having a tapered pin 42 inserted into the interior 44 of the violin body 46 through an opening 48 in the endbutton 50 on the bottom of the violin 40. The opening 48 in the endbutton 50 has means for engaging 52 provided therein. The tapered pin 42 also having means for engagement 54 thereon is interengaged with the means for engaging 52 on the endbutton opening 48 to retain the tapered pin 42 in position. The means for engaging 52, 54 on both the endbutton opening 48 and the tapered pin 42 can be tapered with mating threads 56 having a large pitch to preferably securely engage the tapered pin 42 in place with a relatively small turn of the pin, i.e., ¼ of a turn. As an alternative, a friction fit without threads may be used. Different length pins having different masses can be used with this variation as is indicated by the phantom lined pins 58, 60 in FIG. 3. The material from which the pins herein described are fabricated contributes to the mass as a same size wooden pin has less mass than a comparable steel pin.

The tapered pin 42 is shown in a side view in FIG. 4A. The head 62 of the tapered pin 42 has means for turning 63, such as a recessed socket 64 as shown in FIG. 4B or alternately, a slot or a raised cross bar 66 as shown in FIG. 4C. Any of the configurations for the means for turning facilitates insertion and removal of the various different pins.

A further variation 210 of the device involves the placement of a selectable weight 68 on the chinrest 70 of a violin 40. The weight 68 is selected and attached to a clamp 72 with an Interface 74 interposed between the chinrest 70 and the clamp 72. The provision of the interface 74 which can be a flexible pad 76 allows the clamp 72 tightness to be controllable and thereby the effective mass further controllable. The clamp 72 can be configured as the clamp 12 of FIGS. 2A and 2B, that is as a "C" clamp. The selectable weight 68 can be one of a set having varying calibrated masses and be attachable to the clamp 72, or the clamp 72 on its own can function as the selectable mass by building the desired weight parameter into the clamp body itself.

Figure 5:
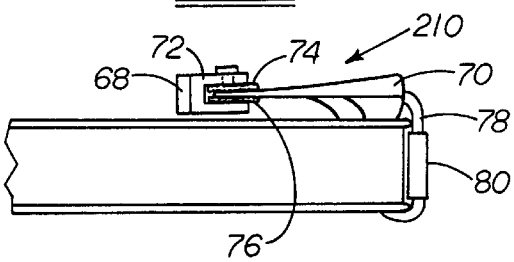
FIG. 5 illustrates a violin having an adjustable weighted chinrest clamp affixed to a chinrest of a violin with a flexible pad interposed between the chinrest and the clamp.

As alternatives to the weight clamp 72 shown in FIG. 5, the chinrest 70 may be modified by adding weight to a purposely hollow interior of the chinrest when it is manufactured or by modifying the chinrest clamp 78. The latter can be easily modified by providing a set of threaded sleeves 80 each differing from the others in mass by changing the outside diameter thereof or the metal alloy used for the sleeve. Further, the effective mass can be adjusted by adding a flexible pad under the chinrest clamp 78 and adjusting the tightness with sleeve 80 or providing a separate similar clamp with a pad elsewhere on the instrument body.

I claim:

1. A device to effect changes in the sound and fell of a stringed instrument by altering the effective mass of the instrument, the stringed instrument having a body and at least one accessory attached to the body, the device comprising means adjustably affixed to said accessory for changing the sound and feel of the stringed instrument, said means including a weight.

2. The device according to claim 1 wherein said at least one instrument accessory is an endpin and said changing means is attached to the endpin.

3. The device according to claim 2 wherein said changing means comprises a clamp body and means for clamping the clamp body to the endpin.

4. The device according to claim 3 wherein the clamp body has an aperture therethrough and the means for clamping the clamp body to the endpin comprising threads disposed on the aperture, the threads being interengageable with the means for clamping.

5. The device according to claim 4 wherein the means for clamping comprises a thread fastener enageable with the threads disposed on the aperture.

6. The device according to claim 1 wherein said accessory is an end button and said changing means is affixed to the end button.

7. The device according to claim 6 wherein the end button has an opening therethrough, the opening having engagement means disposed therein, and said changing means comprises at least one pin having engagement means disposed thereon, said pin thereby interengageable with the opening engagement means.

8. The device according to claim 7 wherein the engagement means disposed on the endbutton and pin comprises threads.

9. The device according to claim 8 wherein the threads have a large pitch to minimize turns to tighten.

10. The device according to claim 7 wherein said pin is a tapered pin.

11. The device according to claim 10 wherein said pin has a head, said head including turning means for turning the pin.

12. The device according to claim 11 wherein the means for turning the pin comprises a recessed socket.

13. The device according to claim 11 wherein the means for turning the pin comprises a raised cross bar.

14. The device according to claim 1 wherein said accessory is a chinrest and said changing means is attached to the chinrest.

15. The device according to claim 14 wherein a flexible pad is located between said changing means and the chinrest.

16. A device for altering the sound and feel of a stringed musical instrument having a body and at least one instrument accessory attached to the body, the device comprising:

a plurality of predetermined masses;

means for altering the sound and feel of the stringed instrument;

said means including at least one of said predetermined masses selectively attached to said at least one instrument accessory.

17. The device of claim 16 wherein the means for altering the sound and feel of the stringed instrument includes a clamping means and said at least one of said predetermined masses selectively attached to said clamping means.

18. The device of claim 16 wherein the at least one of said predetermined masses comprises at least a portion of the instrument accessory.

19. The device of claim 16 wherein a portion of the at least one of said predetermined masses is elastic.

* * * * *